US008177511B2

(12) United States Patent
Brendel et al.

(10) Patent No.: US 8,177,511 B2
(45) Date of Patent: May 15, 2012

(54) BLOWER WHEEL

(75) Inventors: Michael Brendel, Centerville, OH (US); Timothy Schrand, Waynesville, OH (US)

(73) Assignee: Lau Industries, Dayton, OH (US)

( * ) Notice: Subject to any disclaimer, the term of this patent is extended or adjusted under 35 U.S.C. 154(b) by 656 days.

(21) Appl. No.: 12/316,174

(22) Filed: Dec. 10, 2008

(65) Prior Publication Data

US 2010/0143137 A1 Jun. 10, 2010

(51) Int. Cl.
*F01D 5/22* (2006.01)
*F04D 29/18* (2006.01)

(52) U.S. Cl. ..... 416/178; 416/187

(58) Field of Classification Search ..... 416/178, 416/187, 244 R, 204 R
See application file for complete search history.

(56) References Cited

U.S. PATENT DOCUMENTS

| | | | | |
|---|---|---|---|---|
| 2,537,805 | A | 1/1951 | Wilken | |
| 2,803,398 | A * | 8/1957 | Sprouse | 416/187 |
| 3,211,364 | A | 10/1965 | Wentling et al. | |
| 3,335,482 | A | 8/1967 | McClatchie | |
| 4,329,118 | A | 5/1982 | Ranz | 416/178 |
| 4,738,593 | A | 4/1988 | Reifschneider | 416/178 |
| 4,838,762 | A | 6/1989 | Savage et al. | |
| 6,206,640 | B1 * | 3/2001 | Andulics et al. | 416/178 |
| 6,508,627 | B2 | 1/2003 | Gerken et al. | 416/186 R |
| 6,893,220 | B2 * | 5/2005 | Eaton et al. | 415/206 |
| 2008/0267779 | A1 * | 10/2008 | Chiang et al. | 416/178 |

OTHER PUBLICATIONS

CAM York Industrial Co., Ltd., "Centrifugal Strip Wheel Series", pp. 1-4, Dated Oct. 31, 2008.

* cited by examiner

*Primary Examiner* — Dean O Takaoka
*Assistant Examiner* — Alan Wong
(74) *Attorney, Agent, or Firm* — J. A. Thurnau, Esq.; T. A. Dougherty, Esq.; P. N. Dunlap, Esq.

(57) ABSTRACT

A blower wheel comprising a centerdisk comprising a conical portion (16), a planar portion (160) for receiving a hub (7), and an arcuate portion (15) intermediate the conical portion and an outer portion (14), a plurality of blades (2) connected to the outer portion, the blades further connected to a ring (3), and a hub connected to the planar portion, the hub comprising a fastener (13) for attaching the centerdisk to a shaft (200).

1 Claim, 5 Drawing Sheets

BLOWER WHEEL

FIELD OF THE INVENTION

The invention relates to a blower wheel, and more particularly, to a blower wheel comprising a centerdisk comprising a conical portion, a planar portion for receiving a hub, and an arcuate portion intermediate the conical portion and an outer portion.

BACKGROUND OF THE INVENTION

A blower wheel with forward curved blades is commonly found in a wide variety of air moving applications. These may include residential furnaces and air handlers as well as larger commercial heating and air conditioning systems. The fans are typically driven by an electric motor that can be coupled either directly to the motor shaft (direct drive), or through a system of sheaves and belts (belt drive).

The coupling from the motor to the fan occurs at a central rotating disk, or centerdisk, that contains a means to secure the motor shaft and transmit motive force to the fan blades. The centerdisk is often composed of two formed parts that are nested together to create the centerdisk assembly. A hub containing a set-screw, for attachment to the motor shaft, is fastened into the centerdisk.

Due to structural constraints and the need to access the set-screw with a tool a large washer is placed between the two centerdisk parts to provide structural stiffness and clearance to access the set-screw.

Representative of the art is U.S. Pat. No. 4,329,118 (1982) A line of forwardly curved blower wheels of different diameters incorporates blades of the same angular extent in all wheels but with the radii of curvature of the individual blades proportional to the diameter of the wheel wherein they are incorporated. In addition, the center disks of the double inlet wheels and the end plates of the single inlet wheels are provided with novel mounting structure comprising segments bent out of the plane of the disk or end plate and secured to opposite ends of the hub member by which the wheel is mounted on a shaft, and the individual blades are retained in complementary slots in the disk or plate and fillet welded to the disk or plate respectively.

What is needed is a blower wheel comprising a blower wheel comprising a centerdisk comprising a conical portion, a planar portion for receiving a hub, and an arcuate portion intermediate the conical portion and an outer portion. The present invention meets this need.

SUMMARY OF THE INVENTION

The primary aspect of the invention is to provide a blower wheel comprising a centerdisk comprising a conical portion, a planar portion for receiving a hub, and an arcuate portion intermediate the conical portion and an outer portion.

Other aspects of the invention will be pointed out or made obvious by the following description of the invention and the accompanying drawings.

The invention comprises blower wheel comprising a centerdisk comprising a conical portion, a planar portion for receiving a hub, and an arcuate portion intermediate the conical portion and an outer portion, a plurality of blades connected to the outer portion, the blades further connected to a ring, and a hub connected to the planar portion, the hub comprising a fastener for attaching the centerdisk to a shaft.

BRIEF DESCRIPTION OF THE DRAWINGS

The accompanying drawings, which are incorporated in and form a part of the specification, illustrate preferred embodiments of the present invention, and together with a description, serve to explain the principles of the invention.

DETAILED DESCRIPTION OF THE PREFERRED EMBODIMENT

Figure 2:
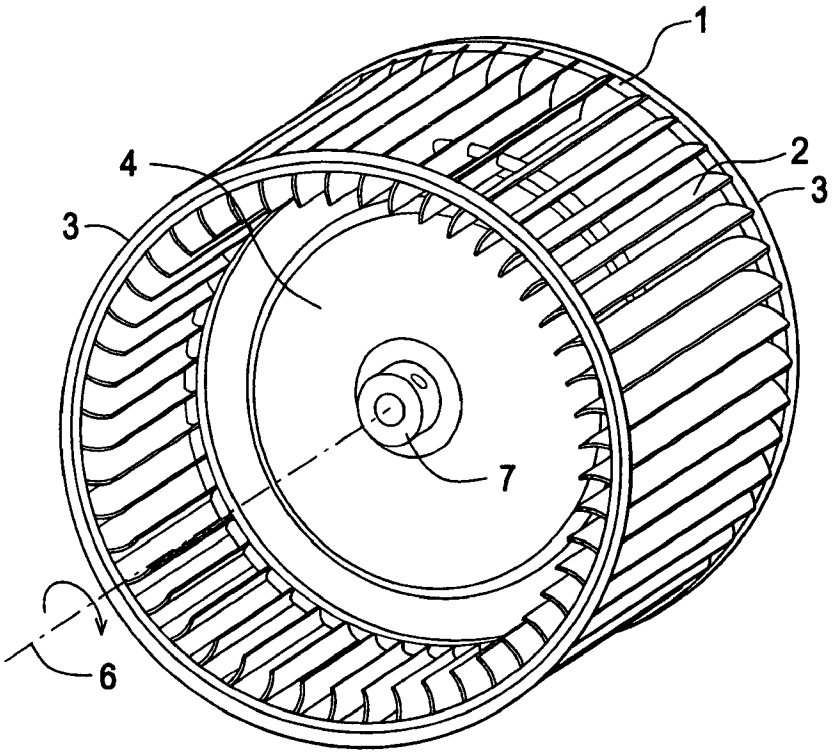
FIG.2 (PRIOR ART)
FIG. 2 is a perspective view of a prior art blower wheel.
Figure 1:
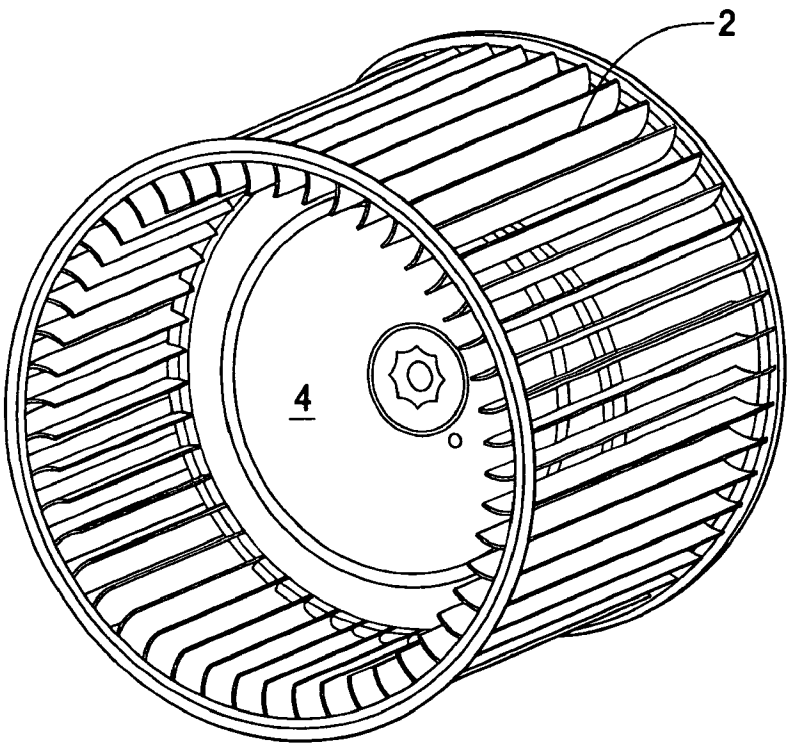
FIG.1 (PRIOR ART)
FIG. 1 is a perspective view of a prior art blower wheel.

FIG. 1 is a perspective view of a prior art blower wheel. FIG. 2 is a perspective view of a prior art blower wheel. A centrifugal fan with forward curved blades 2 is often constructed of five main components. Blades 2 may be individually formed, or formed as part of a continuous ribbon.

A plurality of blades 2 are attached to end-rings 3 by welding, crimping, or any other suitable method. The blades are also fastened to a centerdisk 4 which may be placed at the centerline 5 of the fan, or any other location perpendicular to the axis of rotation 6.

Attached to the centerdisk 4 is a hub 7 that contains a bore for the motor shaft and some means of securing the fan to the motor shaft, namely, a set screw 13. The hub 7 portions may be placed on either side of the centerdisk depending on the access needed to tighten the set-screw 13 and the position of the motor (not shown). These two hub configurations are referred to as concave 8 and convex 9.

Figure 5:
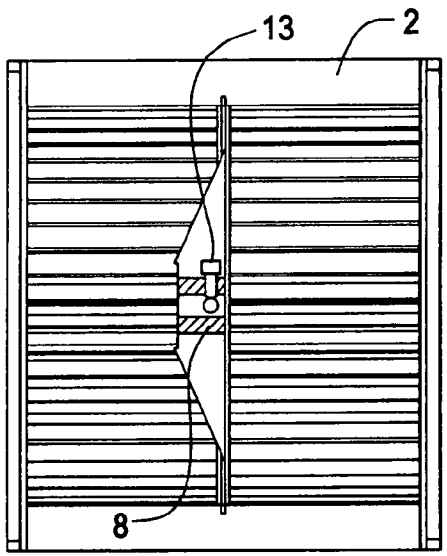
FIG.5 (PRIOR ART)
FIG. 5 is a cross-sectional view of a prior art blower wheel.
Figure 4:
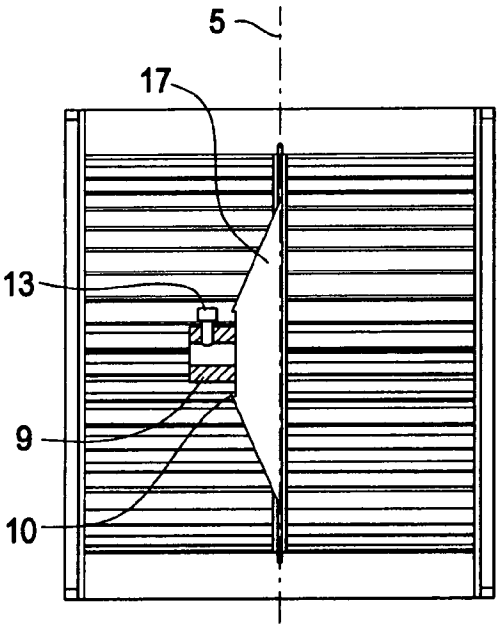
FIG.4 (PRIOR ART)
FIG. 4 is a cross-sectional view of a prior art blower wheel.
Figure 3:
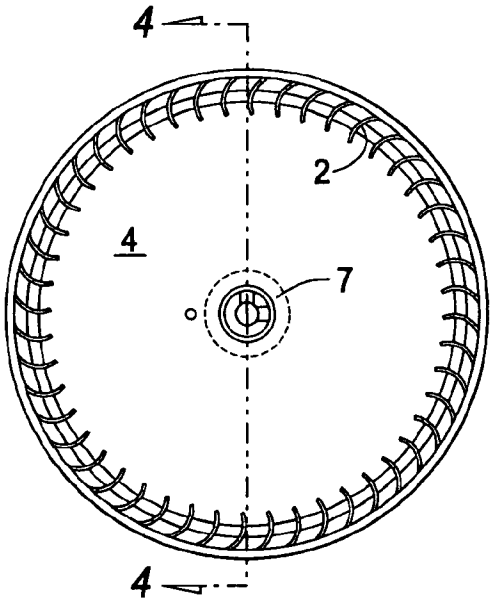
FIG.3 (PRIOR ART)
FIG. 3 is a side-end view of a prior art blower wheel.
Figure 6:
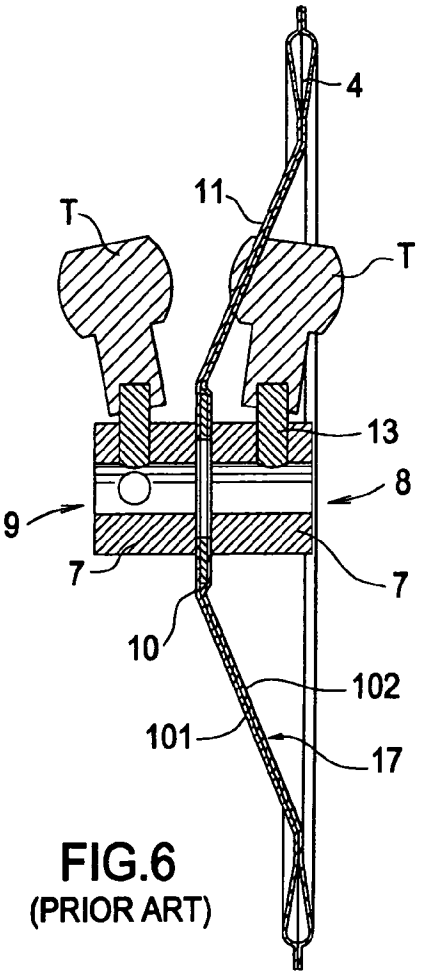
FIG.6 (PRIOR ART)
FIG. 6 is a cross-sectional view of a prior art centerdisk.

FIG. 3 is a side-end view of a prior art blower wheel. FIG. 4 is a cross-sectional view of a prior art blower wheel. FIG. 5 is a cross-sectional view of a prior art blower wheel. FIG. 6 is a cross-sectional view of a prior art centerdisk. Centerdisk 4 is often composed of two identical formed sheet metal components 101, 102 that are nested together to form the complete centerdisk. The prior art geometry for the centerdisk is a frustoconical shape. However, this geometry does not provide adequate access to the set-screw 13 if the conical portion 17 intersects the diameter of the hub 7.

Access can be improved by creating a large planar area adjacent to the hub 7. However, this only serves to weaken the structure unless additional stiffness is provided by adding an intermediate washer 10. Use of the washer 10 adds manufacturing costs to the product. The present invention eliminates the washer 10 while also improving tool access and structural integrity. It does this by the combination of the geometry of the arcuate portion 15 and the inverted conical portion 16, see FIG. 7.

The prior art design often leads to an interference 11 in the concave hub configuration 8 when accessing the set-screw 13, for example, with a pneumatic tool T. The convex hub location is shown at position 9, see FIG. 4 and FIG. 6.

Figure 7:
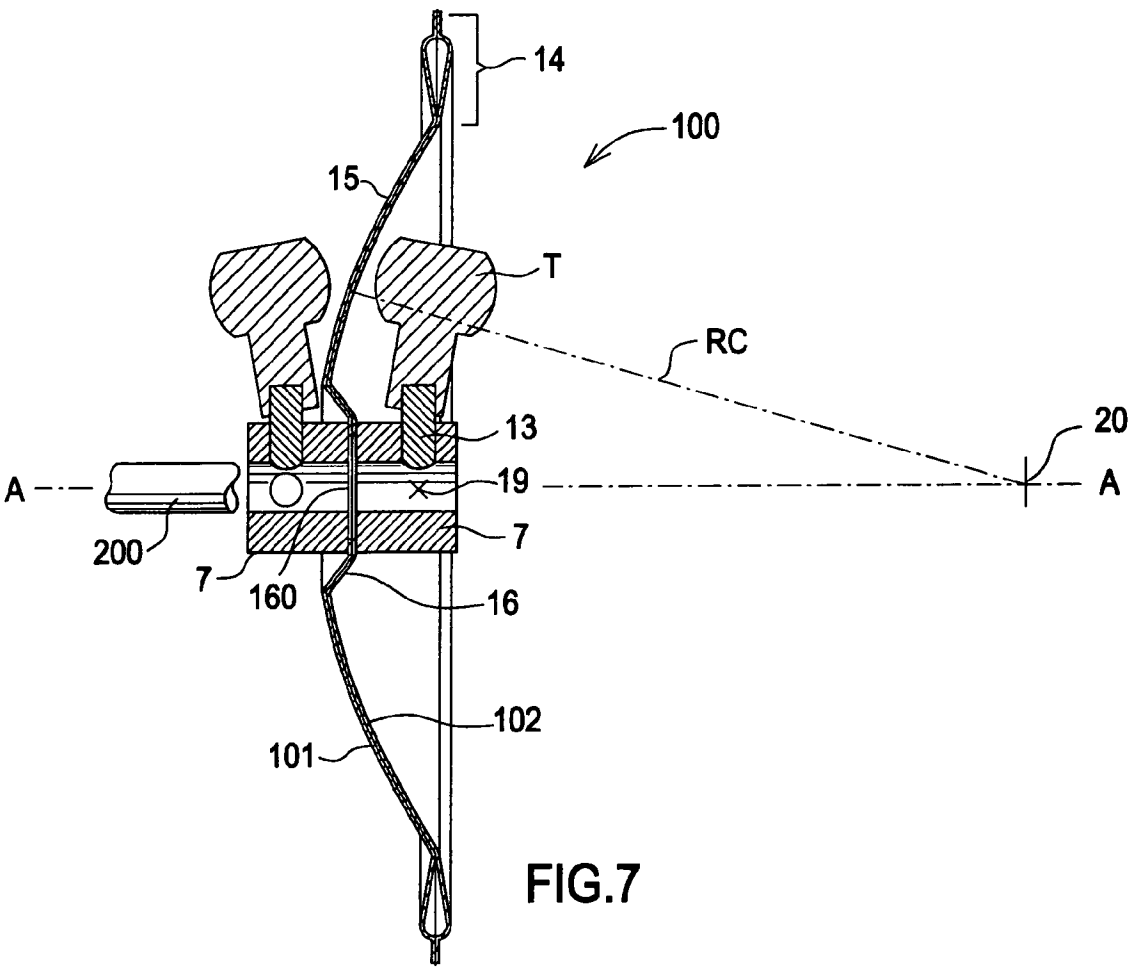
FIG. 7 is a cross-sectional view of an inventive centerdisk.

FIG. 7 is a cross-sectional view of an inventive centerdisk. The inventive centerdisk 100 comprises a formed portion having an arcuate cross-section portion 15. Portion 15 could also be characterized as dished. The center disk comprises two components 101, 102, each of circular sheet metal which are stamped into the disclosed cross-sectional shape. Components 101, 102 are nested together to form the centerdisk 100. The double layer 101, 102 reinforces and strengthens the centerdisk.

Near the center area of the centerdisk, the center of curvature of the arcuate portion 15 is reversed to form a conical portion 16. Conical portion 16 further comprises a centrally disposed planar portion 160 that accepts a hub 7. Planar portion 160 extends in a plane normal to the axis of rotation A-A.

The arcuate geometry of portion 15 provides improved stiffness over previous designs thereby negating the need for a washer for reinforcement. The arcuate portion 15 further enhances tool T clearance to access a set-screw 13.

Outer portion 14 is connected to blades 2. Outer portion 14 comprises a cross-sectional form as shown suited for engaging the blades or may be planar as well.

An apex 19 for the conical portion 16 is disposed on the same side of the centerdisk as the center of curvature 20 of the arcuate portion 15 having a radius RC, each with respect to an axis A-A.

Figure 8:
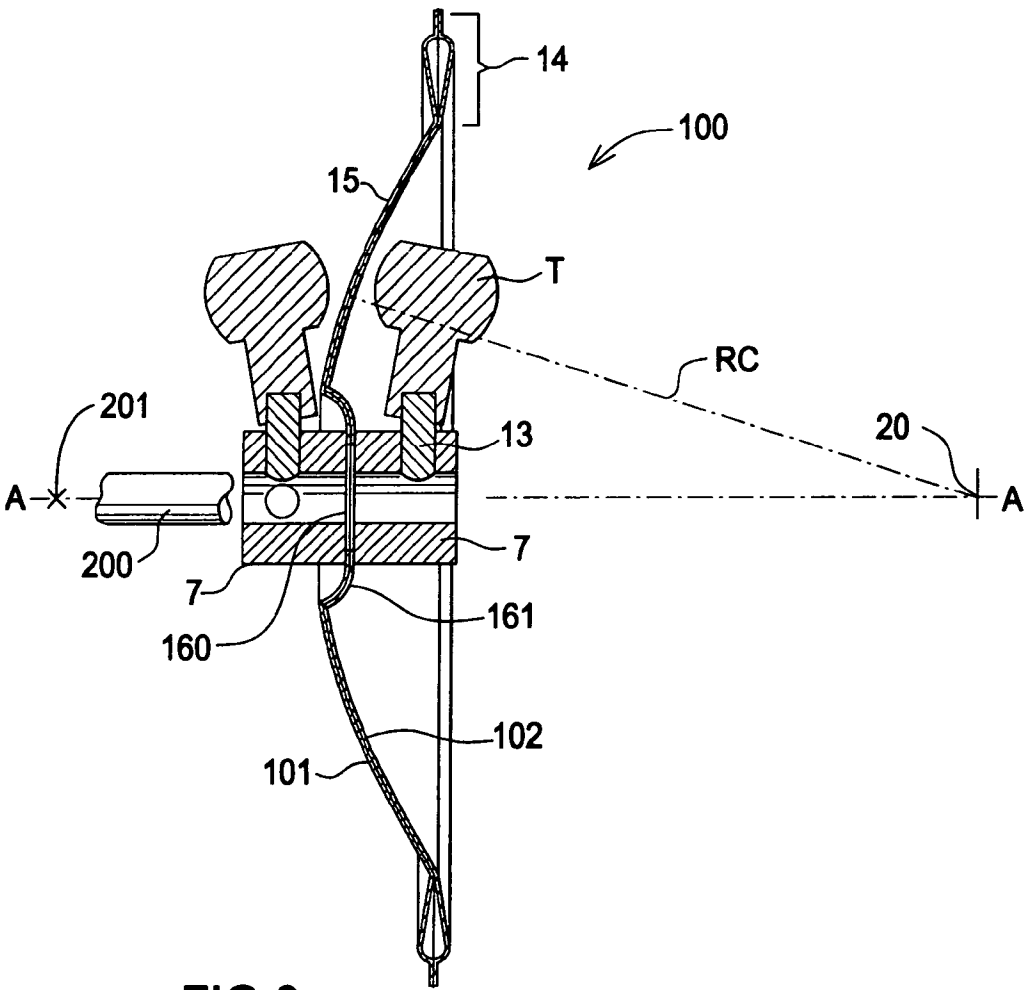
FIG. 8 is a first alternate embodiment.

In a first alternate embodiment as shown in FIG. 8, conical portion 16 instead comprises an arcuate portion 161 having a center of curvature 201 on the side of the wheel opposite the location of center of curvature 20. Arcuate portion 15 is arcuate as described in FIG. 7. This embodiment is otherwise as described in FIG. 7.

Figure 9:
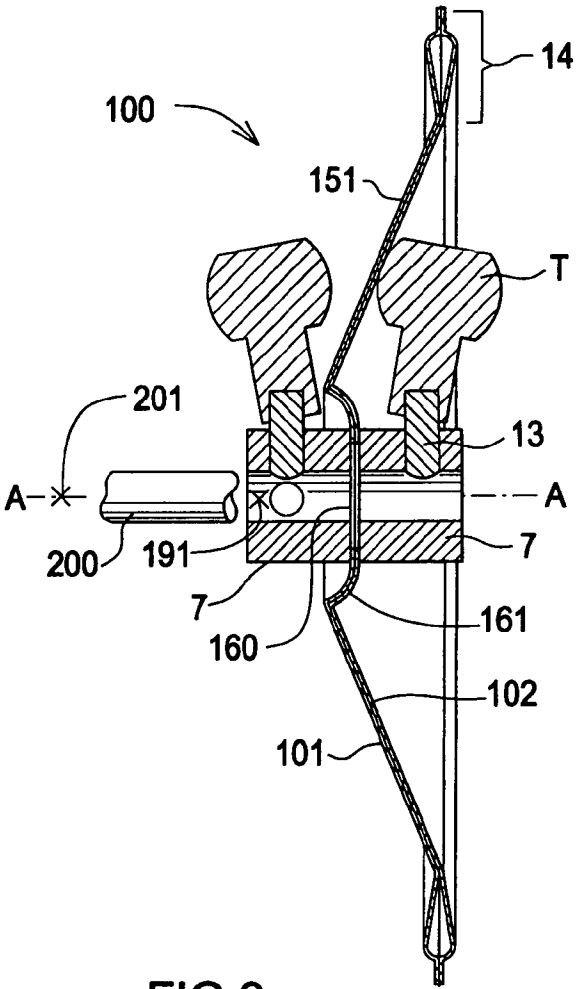
FIG. 9 is a second alternate embodiment.

In a second alternate embodiment as shown in FIG. 9, arcuate portion 15 is instead a conical portion 151. In this second alternate embodiment, conical portion 151 is has an apex 191. Further, in this second alternate embodiment, arcuate portion 161 is as described in FIG. 8 and has a center of curvature 201 on the same side of the wheel as the apex 191. This embodiment is otherwise as described in FIG. 7.

Figure 10:
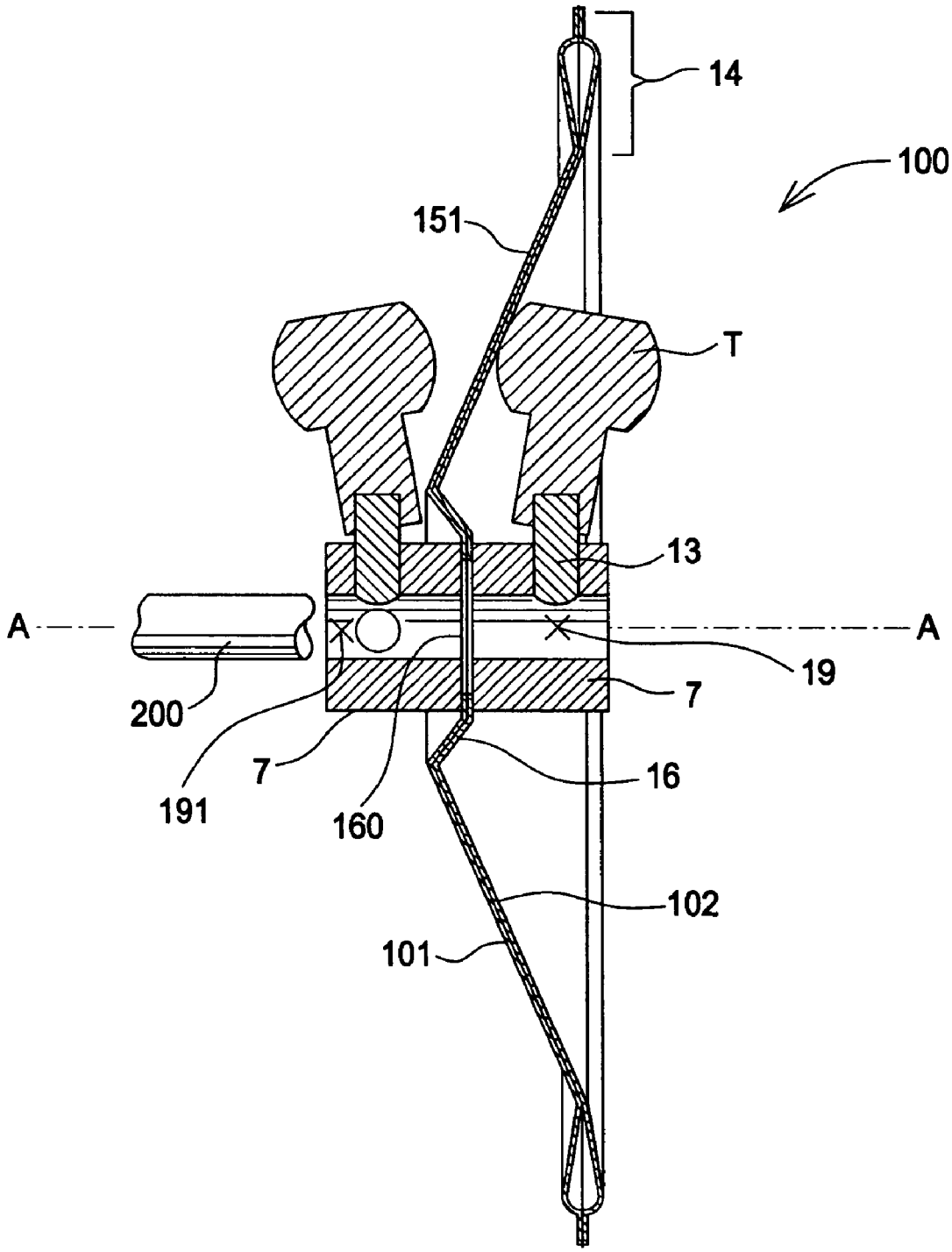
FIG. 10 is a third alternate embodiment.

In a third alternate embodiment as shown in FIG. 10, conical portion 16 is combined with a conical portion 151. Conical portion 151 has apex 191. Conical portion 16 has apex 19 on the side of the wheel that is opposite apex 191. This embodiment is otherwise as described in FIG. 7.

In each of the descriptions, the terms "arcuate" and "conical" refer to a cross-section of the noted portion of the wheel.

Although a form of the invention has been described herein, it will be obvious to those skilled in the art that variations may be made in the construction and relation of parts without departing from the spirit and scope of the invention described herein.

We claim:

1. A blower wheel comprising:

a centerdisk comprising an arcuate portion (161), a planar portion (160) for receiving a hub (7), and a conical portion (151) intermediate the arcuate portion (161) and an outer portion (14);

arcuate portion (161) having a center of curvature (201) on the same side of the wheel as an apex (191) for conical portion (151);

a plurality of blades (2) connected to the outer portion, the blades further connected to a ring (3); and the hub connected to the planar portion, the hub comprising a fastener (13) for attaching the centerdisk to a shaft (200).

* * * * *